US009902038B2

(12) United States Patent
Fukushima et al.

(10) Patent No.: US 9,902,038 B2
(45) Date of Patent: Feb. 27, 2018

(54) POLISHING APPARATUS, POLISHING METHOD, AND SEMICONDUCTOR MANUFACTURING METHOD

(71) Applicant: TOSHIBA MEMORY CORPORATION, Minato-ku (JP)

(72) Inventors: Dai Fukushima, Kuwana (JP); Jun Takayasu, Yokkaichi (JP)

(73) Assignee: TOSHIBA MEMORY CORPORATION, Minato-ku (JP)

( * ) Notice: Subject to any disclaimer, the term of this patent is extended or adjusted under 35 U.S.C. 154(b) by 72 days.

(21) Appl. No.: 14/849,009

(22) Filed: Sep. 9, 2015

(65) Prior Publication Data

US 2016/0233101 A1 Aug. 11, 2016

Related U.S. Application Data

(60) Provisional application No. 62/112,419, filed on Feb. 5, 2015.

(51) Int. Cl.
*H01L 21/304* (2006.01)
*B24B 37/20* (2012.01)

(52) U.S. Cl.
CPC ..... *B24B 37/20* (2013.01)

(58) Field of Classification Search
CPC ..... B24B 37/20
See application file for complete search history.

(56) References Cited

U.S. PATENT DOCUMENTS

| | | | | |
|---|---|---|---|---|
| 5,904,608 | A | 5/1999 | Watanabe | |
| 5,904,609 | A | 5/1999 | Fukuroda et al. | |
| 5,964,643 | A | 10/1999 | Birang et al. | |
| 6,312,321 | B1 | 11/2001 | Fukushima et al. | |
| 7,112,960 | B2 | 9/2006 | Miller et al. | |
| 7,307,023 | B2 | 12/2007 | Fukushima et al. | |
| 7,465,668 | B2 | 12/2008 | Fukushima et al. | |
| 7,753,761 | B2 | 7/2010 | Fujita | |
| 8,778,802 | B2 | 7/2014 | Fukushima et al. | |
| 2003/0190874 | A1* | 10/2003 | So | B24B 29/005 451/56 |
| 2004/0002292 | A1 | 1/2004 | Fukushima et al. | |
| 2005/0118937 | A1 | 6/2005 | Fukushima et al. | |
| 2005/0218008 | A1 | 10/2005 | Fukushima et al. | |
| 2010/0099339 | A1* | 4/2010 | Chen | B24B 37/34 451/287 |

(Continued)

FOREIGN PATENT DOCUMENTS

| | | |
|---|---|---|
| JP | 3-154771 | 7/1991 |
| JP | 9-121556 | 5/1997 |

(Continued)

*Primary Examiner* — Marc Carlson
(74) *Attorney, Agent, or Firm* — Oblon, McClelland, Maier & Neustadt, L.L.P.

(57) ABSTRACT

A polishing apparatus includes a polisher, a holder, and a supplier. The polisher polishes a semiconductor substrate or a polishing target film on a semiconductor substrate. The holder holds the semiconductor substrate and presses the semiconductor substrate or the polishing target film against the polisher to rub the semiconductor substrate or the polishing target film against the polisher. The supplier has a nozzle that is to be inserted to the inside of the polisher and that supplies a polishing solution to the inside of the polisher.

11 Claims, 6 Drawing Sheets

(56) References Cited

U.S. PATENT DOCUMENTS

| | | | | |
|---|---|---|---|---|
| 2012/0064800 | A1 | 3/2012 | Watanabe et al. | |
| 2012/0309267 | A1 | 12/2012 | Shinozaki et al. | |
| 2014/0342640 | A1 | 11/2014 | Fukushima et al. | |
| 2015/0133033 | A1* | 5/2015 | Suen | B24B 37/34 451/11 |

FOREIGN PATENT DOCUMENTS

| | | | |
|---|---|---|---|
| JP | 9-150367 | 6/1997 | |
| JP | 10-58313 | 3/1998 | |
| JP | 10-296615 | 11/1998 | |
| JP | 2000-202758 | 7/2000 | |
| JP | 2001-15467 | 1/2001 | |
| JP | 2002-299294 | 10/2002 | |
| JP | 2003-236749 | 8/2003 | |
| JP | 2004-39673 | 2/2004 | |
| JP | 2004-106123 | 4/2004 | |
| JP | 2004-114183 | 4/2004 | |
| JP | 2005-123232 | 5/2005 | |
| JP | 2005-294707 | 10/2005 | |
| JP | 2006-222285 | 8/2006 | |
| JP | 2006-281384 | 10/2006 | |
| JP | 2007-15107 | 1/2007 | |
| JP | 3872925 | 1/2007 | |
| JP | 2007-115886 | 5/2007 | |
| JP | 4162001 | 10/2008 | |
| JP | 2009-246228 | 10/2009 | |
| JP | 2010-64220 | 3/2010 | |
| JP | 2011-62812 | 3/2011 | |
| JP | 2011-249833 | 12/2011 | |
| JP | 2011-252910 | 12/2011 | |
| JP | 2012-56029 | 3/2012 | |
| JP | 4901301 | 3/2012 | |
| JP | 2012-250309 | 12/2012 | |
| JP | 2014-223684 | 12/2014 | |
| WO | WO 2006003697 A1 * | 1/2006 | B24B 37/26 |

* cited by examiner

POLISHING APPARATUS, POLISHING METHOD, AND SEMICONDUCTOR MANUFACTURING METHOD

CROSS REFERENCE TO RELATED APPLICATIONS

This application is based upon and claims the benefit of priority from the prior U.S. Provisional Patent Application No. 62/112,419 filed on Feb. 5, 2015, the entire contents of which are incorporated herein by reference.

FIELD

The present embodiments relate to a polishing apparatus, a polishing method, and a semiconductor manufacturing method.

BACKGROUND

In recent years, downscaling in manufacturing of a semiconductor device is approaching a physical limit. Accordingly, a semiconductor device has been progressively formed in three dimensions as a new method for increasing the density of chips. For example, development of a FinFET structure as a logic semiconductor and a three-dimensional memory structure as a semiconductor memory has been advanced.

However, there is a problem that loads on processes are greatly increased during formation of a three-dimensional semiconductor device.

For example, in a CMP (Chemical Mechanical Polishing) process to flatten a wafer, the amount of polishing is greatly increased as compared to that in conventional techniques and a required time for the CMP process is also increased due to increase in the polishing amount. Furthermore, when the number of processed wafers is increased, the state of a polishing surface of a polishing pad gradually changes and accordingly the polishing rate may change. For example, at the beginning of use of the polishing pad, a small quantity of abrasive grains remains on the polishing pad. However, when the number of processed wafers increases, the amount of abrasive grains remaining on the polishing pad increases and thus the polishing rate increases.

Accordingly, in the CMP process, it is required to increase the polishing rate while keeping the flatness and also to stabilize the polishing rate.

DETAILED DESCRIPTION

Embodiments will now be explained with reference to the accompanying drawings. The present invention is not limited to the embodiments.

According to an embodiment, a polishing apparatus comprises a polisher, a holder, and a supplier. The polisher polishes a semiconductor substrate or a polishing target film on a semiconductor substrate. The holder holds the semiconductor substrate and presses the semiconductor substrate or the polishing target film against the polisher to rub the semiconductor substrate or the polishing target film against the polisher. The supplier has a nozzle that is to be inserted to the inside of the polisher and that supplies a polishing solution to the inside of the polisher.

(First Embodiment)

Figure 1:
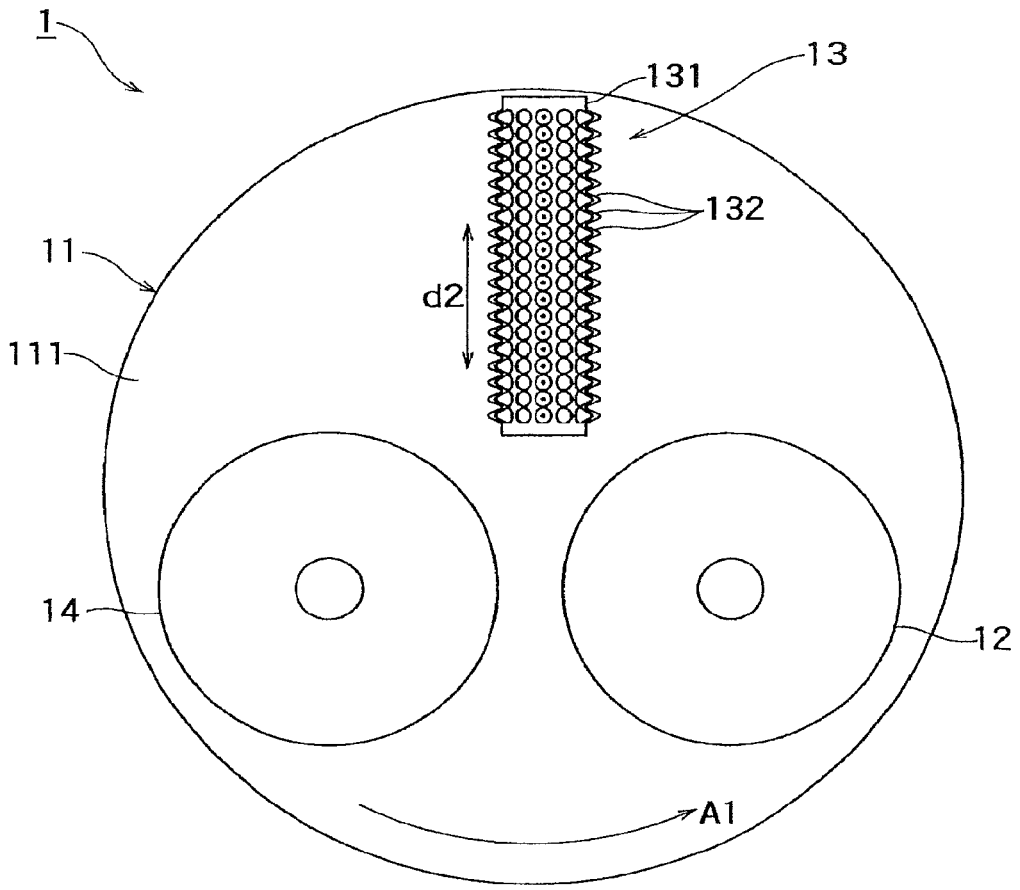
FIG. 1 is a schematic plan view of a polishing apparatus 1 according to a first embodiment.
Figure 2:
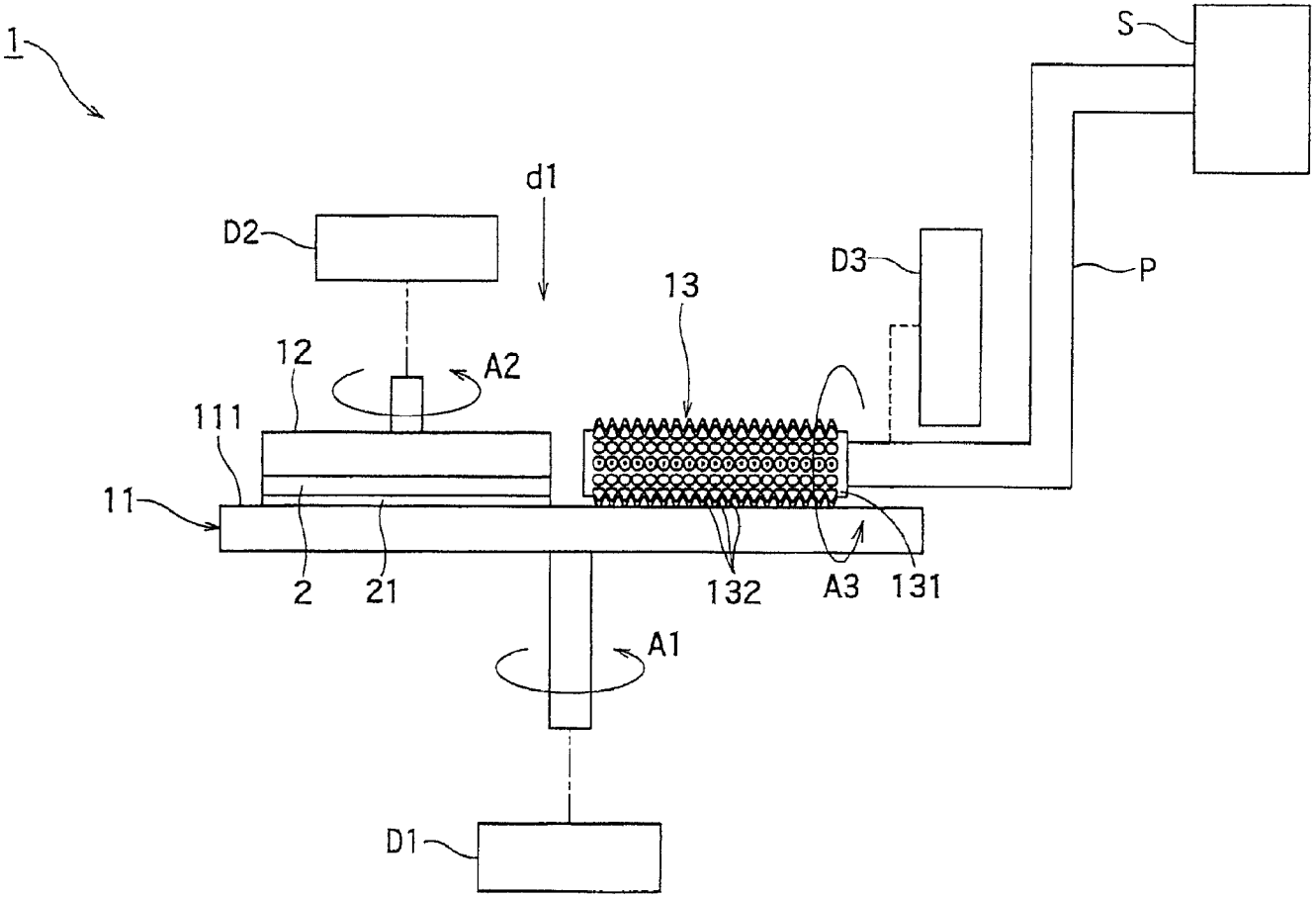
FIG. 2 is a side view of the polishing apparatus 1 shown in FIG. 1.
Figure 3:
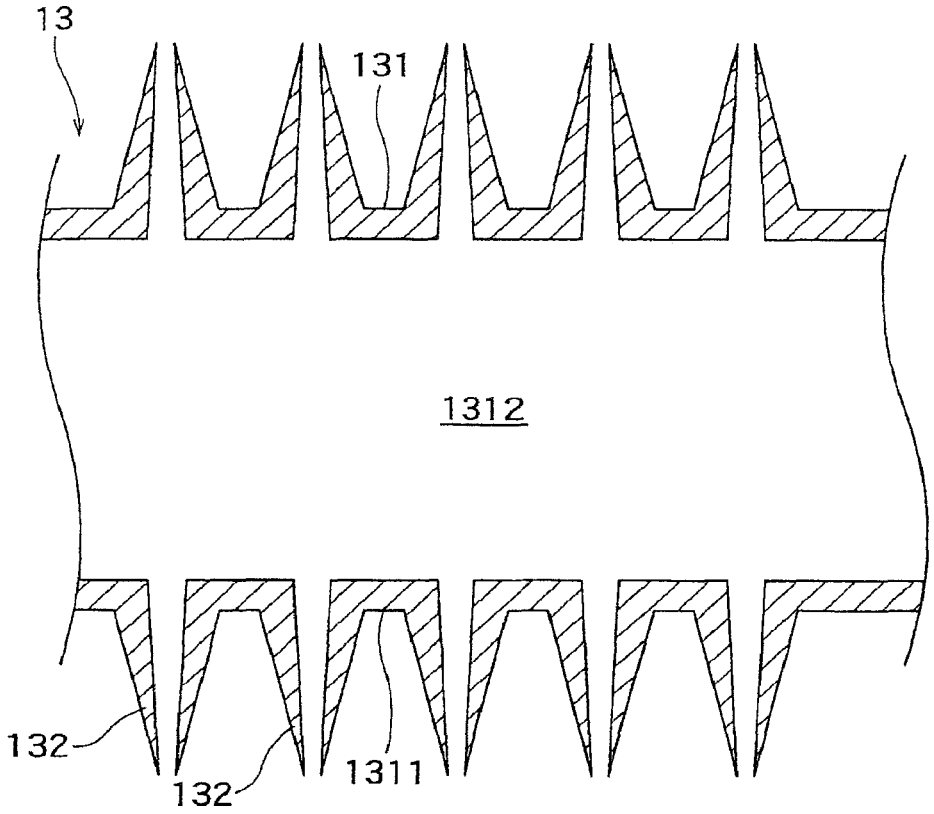
FIG. 3 is a schematic cross-sectional view of a cylindrical member 131 and nozzles 132 of the polishing apparatus 1 shown in FIG. 1.

First, an embodiment of a polishing apparatus that has nozzles protruding from a cylindrical member is explained as a first embodiment. FIG. 1 is a schematic plan view of a polishing apparatus 1 according to the first embodiment. FIG. 2 is a side view of the polishing apparatus 1 shown in FIG. 1. FIG. 3 is a schematic cross-sectional view of a cylindrical member 131 and nozzles 132 of the polishing apparatus 1 shown in FIG. 1.

As shown in FIG. 1, the polishing apparatus 1 includes a polisher 11, a holder 12, a supplier 13, and a dresser 14.

The polisher 11 is, for example, a polishing pad that is made of a resin and that polishes a polishing target film 21 (see FIG. 2) on a semiconductor substrate 2. The polisher 11 has a circular polishing surface 111 that polishes the polishing target film 21. The polisher 11 is capable of rotating in the direction of an arrow A1 around the center of the polishing surface 111 as an axis. The polisher 11 polishes the polishing target film 21 while being rotated by drive force of a drive source D1 (such as a motor) shown in FIG. 2.

The polisher 11 can directly polish the rear surface of the semiconductor substrate 2. The polisher 11 can be formed of, for example, expanded polyurethane to have air holes (micro voids) therein. Because of having the air holes, the polisher 11 can easily hold therein abrasive particles (abrasive grains) of a polishing solution. The polishing solution is a liquid (a solution) to be used for polishing of the polishing target film 21 or the semiconductor substrate 2 and contains abrasive particles. The polishing solution is also called slurry.

The holder 12 is, for example, a platen (a jig) that has the semiconductor substrate 2 adhered thereto to hold the semiconductor substrate 2. To enable the holder 12 to hold the entire circular semiconductor substrate 2, the holder 12 has a disk shape with a larger diameter than that of the semiconductor substrate 2. As shown in FIG. 2, the holder 12 holds the rear surface of the semiconductor substrate 2 and causes the front surface (the polishing target film 21) of the semiconductor substrate 2 to face the polisher 11. The holder 12 presses the polishing target film 21 against the polisher 11 to which the polishing solution is supplied and rubs the polishing target film 21 against the polisher 11, thereby polishing the polishing target film 21. More specifically, the holder 12 polishes the polishing target film 21 while being rotated in the direction of an arrow A2 by drive force of a drive source D2 (such as a motor). The holder 12 is pressed in a downward direction dl by a pressing device (not shown), thereby applying polishing pressure to the polisher 11.

The supplier 13 includes the cylindrical member 131, and a plurality of nozzles 132 protruding at different positions from a surface 1311 of the cylindrical member 131 in order to supply the polishing solution to the polisher 11. The cylindrical member 131 and the nozzles 132 can be formed of the same material (a metal such as stainless steel or a resin, for example) integrally and simultaneously or can be formed of different materials and then joined to each other.

As shown in FIG. 1, the cylindrical member 131 is positioned between a central portion of the polisher 11 and an end portion thereof and the central axis of the cylindrical member 131 is along a radial direction d2 of the polisher 11. The cylindrical member 131 is arranged at a position circumferentially shifted from the holder 12 not to interfere with the holder 12.

A dimension in the direction of the central axis of the cylindrical member 131 is equal to or larger than the diameter of the semiconductor substrate 2. The position of the cylindrical member 131 corresponds to the semiconductor substrate 2 held by the holder 12 in the circumferential direction of the polisher 11. The nozzles 132 are arranged on the surface 1311 of the cylindrical member 131 over the entire range of the central axis direction and are arranged to be continuous in the circumferential direction. With this configuration of the cylindrical member 131 and the nozzles 132, the polishing solution can be efficiently supplied to the entire area of the polisher 11 that is to be subjected to polishing of the semiconductor substrate 2 (hereinafter, also simply "the entire area of the polisher 11") by rotating the cylindrical member 131 and the polisher 11 in a manner as described later.

As shown in FIG. 2, the cylindrical member 131 can be rotated around the central axis (in the direction of an arrow A3) by drive force of a drive source D3 (such as a motor). The cylindrical member 131 rotates on the polishing surface 111 with rotation of the polisher 11 while inserting the nozzles 132 to the inside of the polisher 11.

As shown in FIG. 3, a hollow space 1312 that communicates with the nozzles 132 is provided inside the cylindrical member 131. The polishing solution is supplied to the hollow space 1312 from a supply source S (see FIG. 2) of the polishing solution through a pipe P. The cylindrical member 131 supplies the polishing solution supplied to the hollow space 1312 to the respective nozzles 132. To ensure the rotation of the cylindrical member 131, the pipe P and the cylindrical member 131 can be connected by a rotary joint or the like.

The nozzles 132 supply the polishing solution supplied from the cylindrical member 131 to the polisher 11. Specifically, the nozzles 132 rotate integrally with the cylindrical member 131 and are moved to a position where the nozzles 132 are inserted to the inside of the polisher 11 (that is, at a lower end portion of the cylindrical member 131). The nozzles 132 having being inserted to the inside of the polisher 11 supply the polishing solution supplied from the hollow space 1312 to the inside of the polisher 11. More specifically, the nozzles 132 form notches 112 (see FIG. 4) on the polisher 11 and discharge the polishing solution at the notches 112 to the inside of the polisher 11.

The dresser 14 notches the polisher 11 to prevent the polisher 11 from being clogged with the polishing solution, for example. The dresser 14 includes abrasive grains (not shown) for notching the polisher 11 on a lower end surface thereof that is in contact with the polisher 11. The abrasive grains are, for example, diamond. The dresser 14 notches the polisher 11 while being rotated on the polisher 11 by drive force of a drive source (such as a motor, not shown). A rotation axis of the dresser 14 can be parallel to the rotation axis of the polisher 11.

If the polishing solution is coated on the polisher 11 by rotation (centrifugal force) of the polisher 11, the polishing solution hardly penetrates into the polisher 11 while spreading on the polishing surface 111 of the polisher 11. In this case, it is difficult that the abrasive particles of the polishing solution are sufficiently held (kept) in the polisher 11 and accordingly quick and flat polishing of the polishing target film 21 is difficult. Even if grooves or recesses are formed on the polisher 11, the number of grooves or recesses is limited and thus is insufficient to hold the abrasive particles evenly over the entire polisher 11. Furthermore, even if the dresser 14 notches the polisher 11, it is difficult to hold abrasive particles therein sufficiently. Because the polisher 11 is formed of a resin or the like to have elasticity, the notches are narrowed or closed before the abrasive particles enter therein.

On the other hand, according to the present embodiment, the polishing solution can be discharged through the nozzles 132 at the inside of the notches 112 when the notches 112 are formed by the nozzles 132. Therefore, the abrasive particles can be reliably supplied to the inside of the polisher 11. Accordingly, a sufficient number (quantity) of abrasive particles can be held in the polisher 11 and thus the polishing target film 21 can be polished quickly and flatly. Furthermore, because a high polishing rate can be ensured from the beginning of use of the polisher 11 regardless of the number of processed semiconductor substrates 2, the polishing rate can be stabilized.

Figure 4:
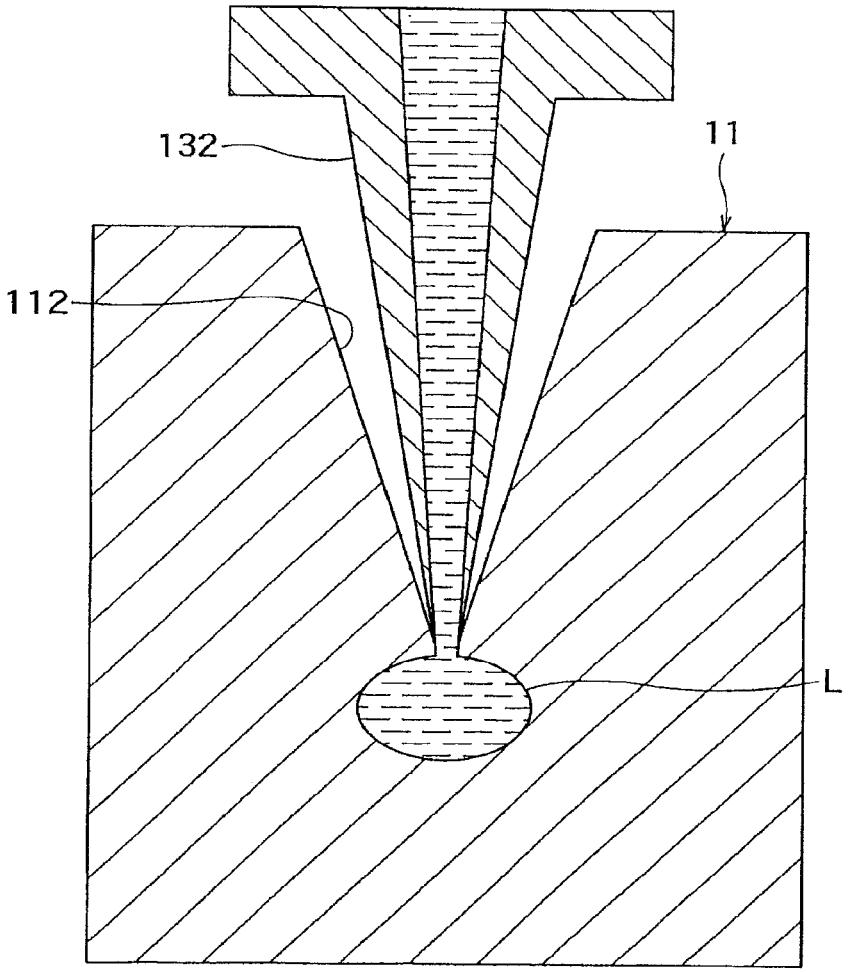
FIG. 4 is a schematic cross-sectional view of a polishing method according to the first embodiment.

An example of a polishing method to which the polishing apparatus 1 shown in FIG. 1 is applied is explained next with reference to also FIG. 4. FIG. 4 is a schematic cross-sectional view of a polishing method according to the first embodiment.

First, the cylindrical member 131 is positioned on the polisher 11 by a moving mechanism (not shown) for the cylindrical member 131 and the nozzles 132 at the position of a lower end portion of the cylindrical member 131 are inserted to the inside of the polisher 11. At that time, the cylindrical member 131 can be pressed in the downward direction dl (see FIG. 2) by a moving mechanism or a pressing mechanism (not shown).

Next, as shown in FIG. 2, the polisher 11 is rotated in the direction of the arrow Al by the drive source D1 and the cylindrical member 131 is rotated in the direction of the arrow A3 by the drive source D3. Accordingly, the cylindrical member 131 rotates with rotation of the polisher 11 while inserting the nozzles 132 to the inside of the polisher 11. At that time, the polishing solution is supplied from the supply source S (see FIG. 2) into the hollow space 1312 (see FIG. 3) of the cylindrical member 131 and the supplied polishing solution is further supplied to the nozzles 132.

As shown in FIG. 4, the nozzles 132 inserted into the polisher 11 discharge the polishing solution (denoted by reference character L in FIG. 4) supplied from the hollow space 1312 to the inside of the polisher 11 at lower end portions of the notches 112 formed by the insertion. The polishing solution can be thereby reliably supplied to the inside of the polisher 11.

Because the polisher 11 and the cylindrical member 131 both rotate, supply of the polishing solution by the nozzles 132 to the inside of the polisher 11 can be achieved evenly over the entire area of the polisher 11.

When the polisher 11 made of a material having air holes is used, the polishing solution is discharged from the nozzles 132 into the air holes, thereby enabling the abrasive particles to remain in the air holes. Therefore, more abrasive particles can be held. When the polisher 11 having air holes is used, tip portions (discharge openings) of the nozzles 132 can be inserted to, for example, a depth of 1 to 200 micrometers to enable the tip portions to reach the air holes. Although not particularly limited, the flow rate of the polishing solution per one nozzle 132 can be, for example, 1 ml/min or lower. In this case, assuming that the number of the nozzles 132 is 100, the polishing solution can be supplied at a total flow rate not exceeding 100 ml/min and thus the flow rate of the polishing solution can be suppressed.

The nozzles 132 can also discharge the polishing solution outside the notches 112. The polishing solution discharged outside the notches 112 can be supplied to the polishing surface 111.

Next, the holder 12 rotates with the polishing target film 21 being pressed against the polisher 11 to which the polishing solution is supplied, thereby polishing the polishing target film 21. Because a sufficient number of abrasive particles are held in the polisher 11 at that time, the polishing target film 21 can be polished quickly and flatly.

Therefore, according to the present embodiment, because the polishing solution can be reliably supplied to the inside of the polisher 11 at the notches 112 when the notches 112 are formed on the polisher 11 by the nozzles 132, a sufficient number of abrasive particles can be held in the polisher 11. The holder 12 can thereby polish the polishing target film 21 quickly and flatly at a stable polishing rate by using a sufficient number of abrasive particles. That is, according to the present embodiment, the polishing rate can be improved while the flatness is ensured and also the polishing rate can be stabilized.

The polishing apparatus 1 according to the present embodiment can be applied to flattening of an insulating film (an oxide film) or the like in a manufacturing process of a three-dimensional semiconductor device such as a three-dimensional stack memory. By applying the polishing apparatus 1 according to the present embodiment to the manufacturing process of the three-dimensional semiconductor device, the manufacturing efficiency can be improved while the quality of the three-dimensional semiconductor device is maintained.

(Second Embodiment)

Figure 5:
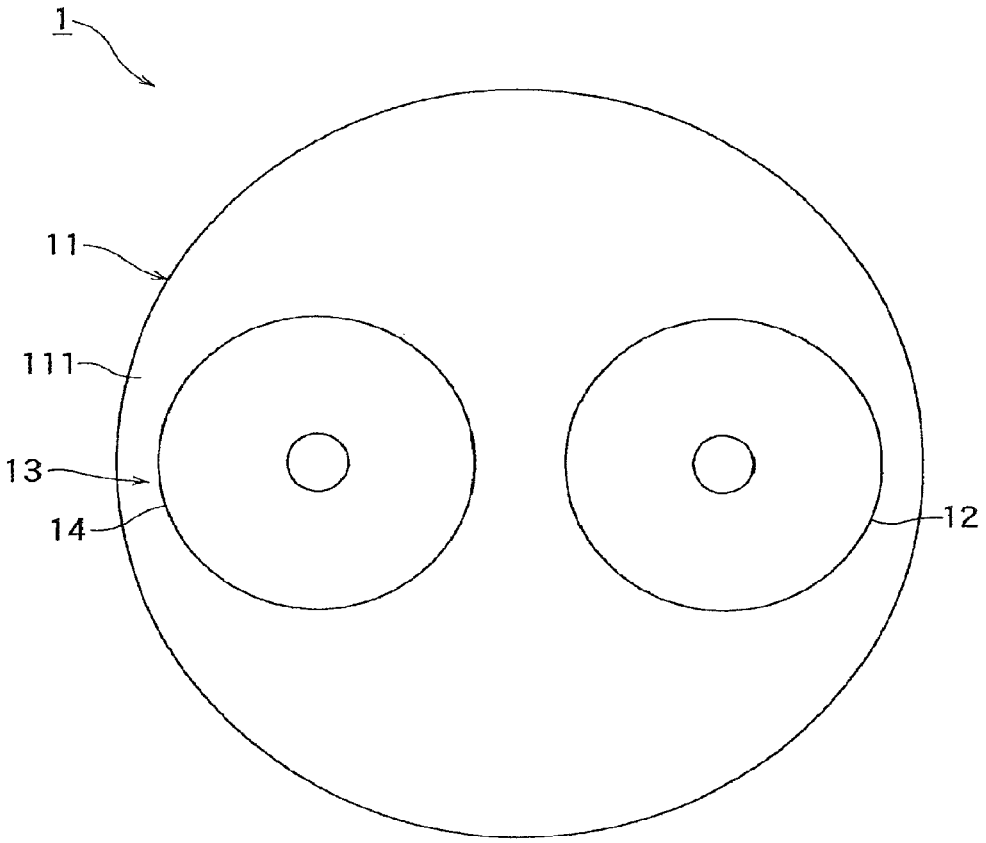
FIG. 5 is a schematic plan view of the polishing apparatus 1 according to a second embodiment.
Figure 6:
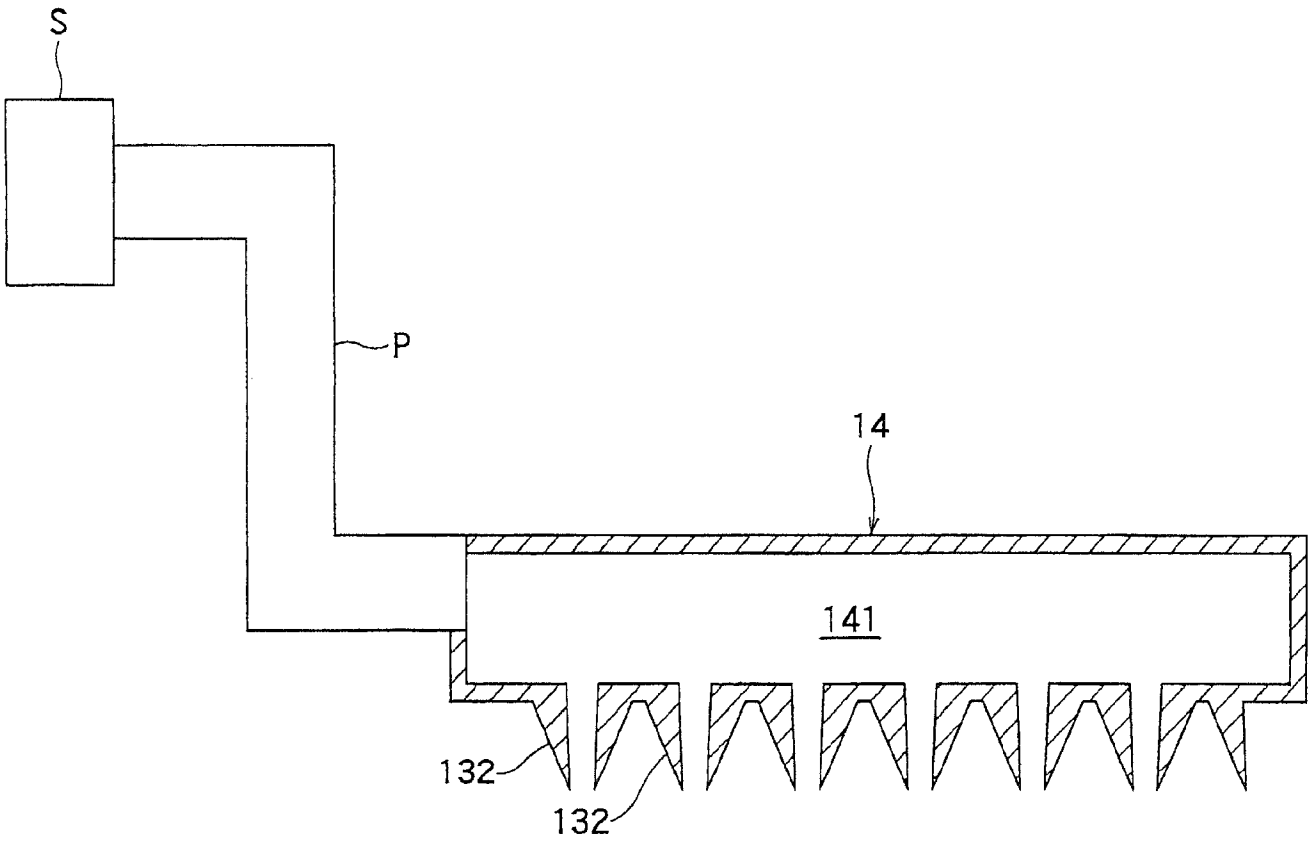
FIG. 6 is a cross-sectional view of a dresser 14 of the polishing apparatus 1 shown in FIG. 5.

An example of the polishing apparatus 1 having nozzles provided in a dresser according to a second embodiment is explained next. In the second embodiment explained below, constituent elements identical to those of the first embodiment are denoted by like reference characters and redundant explanations thereof will be omitted. FIG. 5 is a schematic plan view of the polishing apparatus 1 according to the second embodiment. FIG. 6 is a cross-sectional view of a dresser of the polishing apparatus 1 shown in FIG. 5.

The supplier 13 according to the second embodiment has a different configuration from that of the supplier 13 independent of the dresser 14 according to the first embodiment and is combined (integrated) with the dresser 14. That is, the supplier 13 also functions as the dresser 14.

Specifically, as shown in FIG. 6, the dresser 14 includes the nozzles 132 instead of the abrasive grains explained in the first embodiment. A hollow space 141 that communicates with the nozzles 132 is provided inside the dresser 14. The hollow space 141 is connected to the supply source S of the polishing solution via the pipe P. Therefore, the dresser 14 can discharge the polishing solution supplied from the supply source S to the hollow space 141 through the nozzles 132.

According to the present embodiment, the nozzles 132 form the notches 112 on the polisher 11 and the polishing solution can be supplied to the inside of the polisher 11 at the notches 112 similarly to the first embodiment. Therefore, also in the second embodiment, the polishing rate can be improved while the flatness is ensured and also the polishing rate can be stabilized. Furthermore, the number of components and the cost can be reduced by integrating the nozzles 132 and the dresser 14.

In the first embodiment, the cylindrical member 131 can be supported to be capable of rotating instead of being driven by the drive source D3. In this case, rotation of the polisher 11 with the cylindrical member 131 being pressed against the polisher 11 enables the cylindrical member 131 to rotate following the rotation of the polisher 11. Therefore, similarly to the configuration shown in FIG. 1, the cylindrical member 131 can rotate while inserting the nozzles 132 into the polisher 11 and thus the polishing solution can be supplied over the entire area of the polisher 11. Furthermore, because the drive source D3 can be omitted, the cost can be reduced.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

The invention claimed is:

1. A polishing apparatus comprising:

a holder provided to face a surface of a polishing pad polishing a semiconductor substrate or a polishing target film on a semiconductor substrate, holding the semiconductor substrate and pressing the semiconductor substrate or the polishing target film against the polishing pad to rub the semiconductor substrate or the polishing target film against the polishing pad; and a supplier arranged on an area of the polishing pad different from an area of the polishing pad on which the holder is positioned and having a nozzle that is to be inserted to inside of the polishing pad and that supplies a polishing solution to the inside of the polishing pad, wherein the supplier rotates on the polishing pad and forms a notch on the polishing pad by inserting the nozzle into the polishing pad; and the nozzle discharges the polishing solution to the inside of the polishing pad at the notch.

2. The apparatus of claim 1, wherein the supplier includes a plurality of the nozzles.

3. The apparatus of Claim 1, wherein the polishing pad comprises a circular polishing surface to rotate around a center of the polishing surface, the supplier includes a cylindrical member rotating on the polishing surface with rotation of the polishing pad, and the nozzle protrudes from a surface of the cylindrical member.

4. The apparatus of claim 3, wherein the cylindrical member internally comprises a hollow space that communicates with the nozzle and supplies the polishing solution to the nozzle via the hollow space.

5. The apparatus of claim 3, wherein the cylindrical member is positioned between a central portion of the polishing pad and an end portion of the polishing pad and rotates while inserting the nozzle to the inside of the polishing pad with rotation of the polishing pad.

6. The apparatus of claim 1, wherein the nozzle is provided on a dresser.

7. A polishing method comprising:

inserting a nozzle to inside of a polishing pad that polishes a semiconductor substrate or a polishing target film on a semiconductor substrate and supplying a polishing solution to the inside of the polishing pad through the nozzle; and rubbing the semiconductor substrate or the polishing target film against the polishing pad having the polishing solution supplied therein with the semiconductor substrate or the polishing target film pressed against the polishing pad in an area different from an area on which the nozzle is positioned, wherein the nozzle rotates on the polishing pad and forms a notch on the polishing pad by inserting into the polishing pad: and the nozzle discharges the polishing solution to the inside of the polishing pad at the notch.

8. The method of claim 7, wherein the polishing pad comprises a circular polishing surface, the nozzle protrudes from a surface of a cylindrical member, and the polishing pad is rotated around a center of the polishing surface and the cylindrical member is rotated on the polishing surface with rotation of the polishing pad.

9. The method of claim 8, wherein the cylindrical member is positioned between a central portion of the polishing pad and an end portion of the polishing pad and is rotated while inserting the nozzle to the inside of the polishing pad with rotation of the polishing pad.

10. The method of claim 8, wherein the cylindrical member internally comprises a hollow space that communicates with the nozzle, and the polishing solution is supplied to the nozzle via the hollow space.

11. A semiconductor manufacturing method comprising:

inserting a nozzle to inside of a polishing pad that polishes a semiconductor substrate or a polishing target film on a semiconductor substrate and supplying a polishing solution to the inside of the polishing pad through the nozzle; and rubbing the semiconductor substrate or the polishing target film against the polishing pad having the polishing solution supplied therein with the semiconductor substrate or the polishing target film pressed against the polishing pad in an area different from an area on which the nozzle is positioned, wherein the nozzle rotates on the polishing pad and forms a notch on the polishing pad by inserting into the polishing pad; and the nozzle discharges the polishing solution to the inside of the polishing pad at the notch.

* * * * *